US005366536A

United States Patent [19]

Suwa et al.

[11] Patent Number: 5,366,536

[45] Date of Patent: Nov. 22, 1994

[54] METHOD OF MELTING METALS

[75] Inventors: Toshio Suwa; Nobuaki Kobayashi, both of Yamanashi, Japan

[73] Assignee: Nippon Sanso Corporation, Tokyo, Japan

[21] Appl. No.: 37,168

[22] Filed: Mar. 26, 1993

[30] Foreign Application Priority Data

Mar. 27, 1992 [JP] Japan ..... 4-071528

[51] Int. Cl.[5] ..... C21B 11/00

[52] U.S. Cl. ..... 75/414; 75/571; 75/575; 75/581

[58] Field of Search ..... 75/571, 573, 575, 581, 75/414

[56] References Cited

U.S. PATENT DOCUMENTS

| | | | |
|---|---|---|---|
| 1,376,479 | 5/1921 | Stoughton | 75/380 |
| 4,681,535 | 7/1987 | Kobari et al. . | |
| 4,758,270 | 7/1988 | Bardenheuer | 75/574 |
| 4,786,321 | 11/1988 | Hoster et al. | 266/215 |
| 4,928,605 | 5/1990 | Suwa et al. . | |

FOREIGN PATENT DOCUMENTS

| | | |
|---|---|---|
| 2427360 | 1/1975 | Germany . |
| 2704101 | 8/1977 | Germany . |
| 3610498 | 10/1987 | Germany . |
| 8706331 | 10/1987 | WIPO . |

OTHER PUBLICATIONS

Database WPI, Week 13, 1970; AN 70-21549R & CA-A-838 032.

Patent Abstracts of Japan, vol. 6, No. 113 (M-138) Jun. 24, 1982 & JP-A-57 041 521 (Daido Steel Co. Ltd) Mar. 8, 1982.

*Primary Examiner*—Melvyn J. Andrews

*Attorney, Agent, or Firm*—Armstrong, Westerman, Hattori, McLeland & Naughton

[57] ABSTRACT

Disclosed is a method of melting a metal, which can demonstrate improved heat efficiency, increased yield and minimized pollutive gas generation. In this method, a metallic material stacked in a melting furnace is melted by heating it directly with the flame from a fuel burner using an oxygen gas having a purity of 60 to 100% as a combustion assisting gas. The oxygen gas is burned at an oxygen-to-fuel ratio of 0.55 to 0.99, while the unburned portion of the combustion gas is allowed to burn by $O_2$ supplied separately through oxygen lances. Meanwhile, the metallic material is preheated by burning the unburned portion of the combustion gas, whereas the combustion assisting gas is heated before it is fed to the burner.

5 Claims, 2 Drawing Sheets

METHOD OF MELTING METALS

BACKGROUND OF THE INVENTION AND RELATED ART STATEMENT

This invention relates to a method of melting a metal, particularly to the method which is suitable for melting iron scraps having a high melting point While melting of metals, particularly iron scraps, is generally achieved by utilizing arcing in an electric furnace, the iron scraps melt nonuniformly and so-called cold spots are liable to occur according to this method. Accordingly, it is also practiced to employ an oxygen-assisted fuel burner in combination with the electric furnace.

Meanwhile, the oxygen injection method is also employed in order to promote productivity and melting speed. In this method, a micropowdery coal and coke are injected together with oxygen into the melt remaining in the furnace to effect an oxidation reaction whereby to melt the scraps by the heat of reaction.

However, the first method of melting a metal using an electric furnace described above involves a disadvantage that cold spots are inevitably left in the metal and that it must resort to the electric power as the source of energy, although it has an advantage that it can readily yield a high temperature and allows easy temperature adjustment. Meanwhile, in the second method in which an oxygen-assisted fuel burner is used in addition to the electric furnace, 60 to 80% of the total energy resorts to the electric power, and besides it is well known that the energy efficiency of the electric power is only about 20 to 25%, when generating efficiency, melting efficiency, etc. are all taken into consideration. In addition, referring to the generation of $CO_2$ which is notorious as a causative of global environmental disruption, it is reported that about 150 $m^3$ of $CO_2$ is generated for melting 1 ton of metal scraps utilizing the electric power generated by use of heavy oils, so that a countermeasure therefor must be taken.

In the oxygen injection method, the above problems can be cleared since no electric power is employed. However, in this method, oxygen, a micropowdery coal and coke are injected to the melt to carry out an oxidation reaction and effect melting of the metal, so that a portion of the melt must constantly be allowed to remain in the melting furnace. This may cause no problem when the melting operation is carried out continuously, but inevitably yields poor productivity in the case of a batchwise melting operation or of intermittent melting operation, since the melt cannot entirely be removed from the melting furnace.

Meanwhile, the fuel is usually burned at an oxygen-to-fuel ratio of from 1.0 to 1.5 in the oxygen-assisted fuel burner, and use of such type of burner for melting iron scraps causes reduction in the yield due to oxidation of the scraps and the like to be caused by the excess amount of oxygen, leading to a metal loss. In addition, this burner further involves a disadvantage that the recarburizer is also burned based on the same reason and that $NO_x$ are generated in large amounts.

OBJECT AND SUMMARY OF THE INVENTION

This invention is directed to provide a method of melting a metal, which can yield excellent heat efficiency, improve yield and minimize generation of pollutive gas.

According to a first aspect of the invention, a metallic material introduced to a melting furnace is melted by heating it directly with the flame from a fuel burner using an oxygen gas having a purity of 60 to 100% as a combustion assisting gas, wherein the oxygen gas fed to the fuel burner is burned at an oxygen-to-fuel ratio of from 0.55 to 0.99, and the unburned portion of the combustion gas (hereinafter simply referred to as unburned gas) is allowed to burn by $O_2$ fed separately.

In a second aspect of the invention, the metallic material according to the first aspect of the invention is preheated by the combustion of the unburned gas.

In a third aspect of the invention, the combustion assisting gas according to the first aspect of the invention is heated before it is fed to the burner.

In a fourth aspect of the invention, the source for heating the combustion assisting gas according to the third aspect of the invention is the combustion gas exhausted from the melting furnace.

In a fifth aspect of the invention, the source for heating the combustion assisting gas according to the third aspect of the invention is a preheater provided separately.

The method of this invention can demonstrate excellent heat efficiency and high melting performance, since the metallic material stacked in the melting furnace is melted by heating it directly with the flame from the fuel burner only, using an oxygen gas having a purity of 60 to 100% as the combustion assisting gas. Besides, since the melt need not be allowed to remain in the melting furnace, the melting operation can be performed with no problem even if it is carried out batchwise, not to speak of continuous operation.

Moreover, since the fuel fed to the burner is adapted to be burned in an oxygen-poor atmosphere, while the unburned gas to be burned by supplying $O_2$ separately, the metal loss due to the oxidation of the metal can greatly be reduced, and also thus burning of the recarburizer can be prevented to reduce the relative amount of $NO_x$ to be generated.

Meanwhile, the heat of combustion generated by burning the unburned gas can be utilized for preheating the metallic material.

Further, a high combustion efficiency can be obtained by heating the combustion assisting gas before it is fed to the burner, so that a solid fuel such as a micropowdery coal can be used.

It can also be pointed out that $CO_2$ can easily be recovered, advantageously according to the method of the invention, since the $CO_2$ concentration in the exhaust gas is relatively high, e.g. 50% or more.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Preferred embodiments of the invention will be described below referring to the attached drawings.

Figure 1:
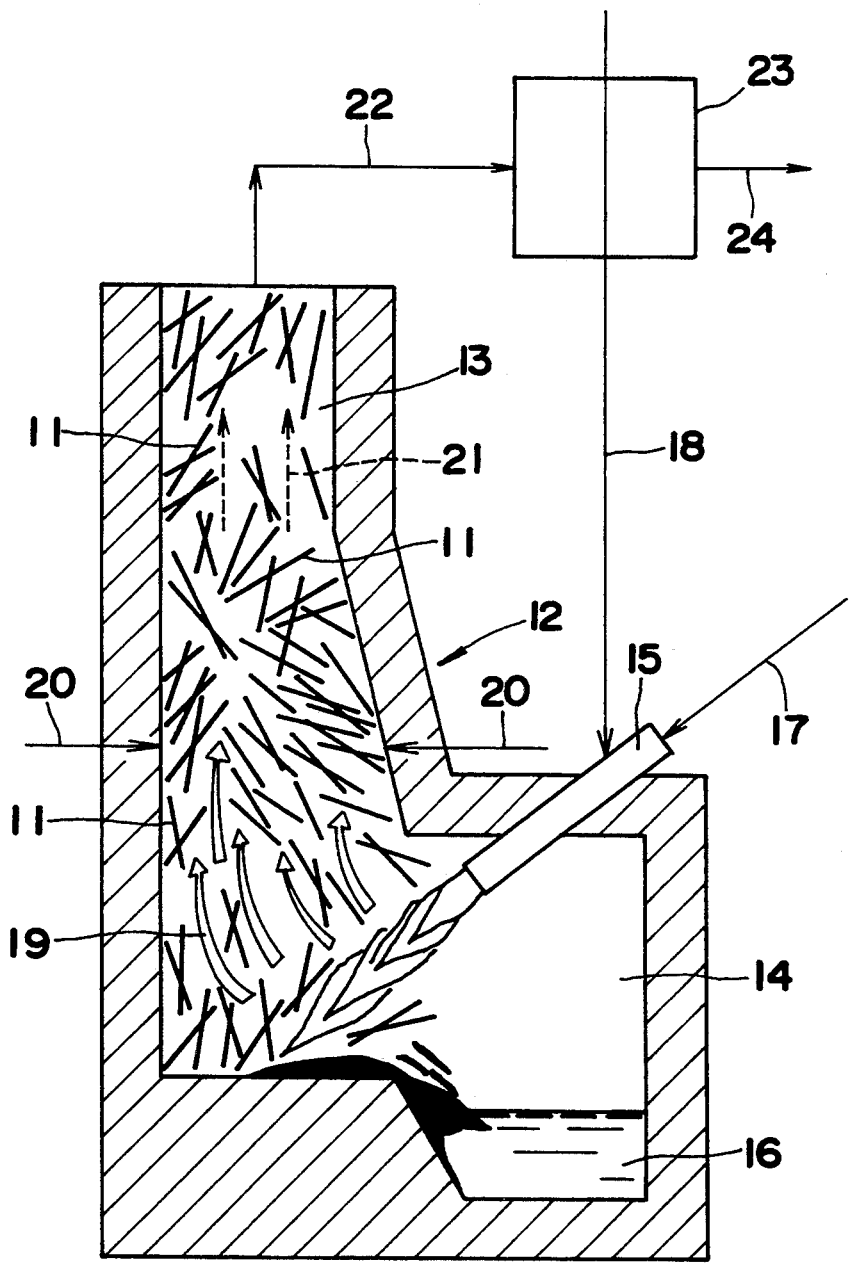
FIG. 1 shows a flow diagram for explaining one embodiment of the invention together with a sectional view of a melting furnace.
Figure 2:
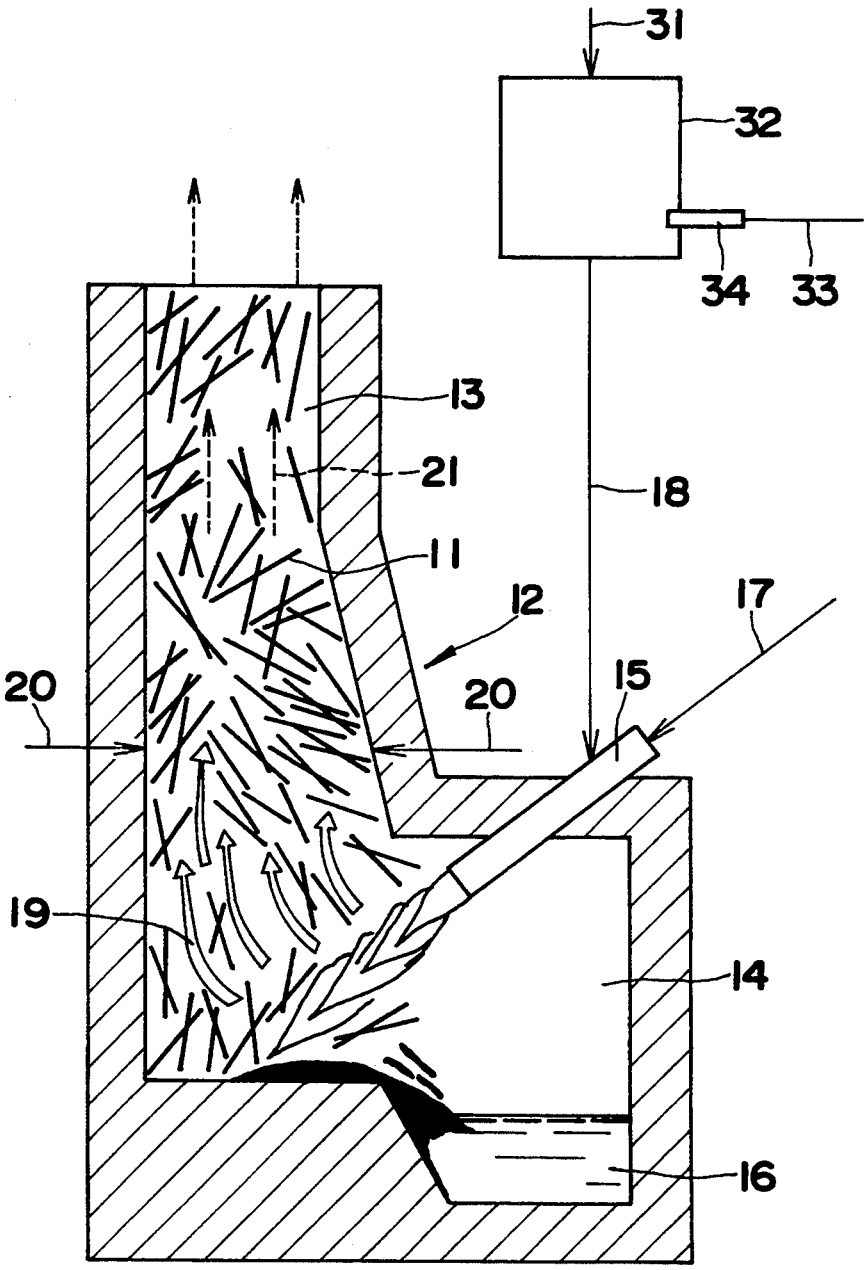
FIG. 2 shows a flow diagram for explaining another embodiment of the invention together with a sectional view of a melting furnace.

In FIGS. 1 and 2, a metallic material 11 is introduced through an inlet zone 13 defined at the upper part of a melting furnace 12 and stacked in a melting zone 14. The metallic material 11 stacked in the melting zone 14 is melted by direct contact with the flame from a burner 15 disposed to penetrate through the wall of the furnace to appear in the melting zone 14, and the resulting melt flows down into a well zone 16. The melt in the well zone 16 is removed to the outside of the furnace in a manner well known in the art.

To the burner 15 are fed a fuel such as a heavy oil, LPG or a micropowdery coal through a pipe 17, as well as, an oxygen gas having a purity of 60 to 100% heated to a desired temperature as the combustion supporting gas through a pipe 18.

Melting tests were carried out for iron scraps using a heavy oil, LPG and a micropowdery coal, respectively, while changing the oxygen purity of the combustion assisting gas to obtain the melting efficiency data. The results are as shown in the following Table 1. The speed of the combustion assisting gas to be jetted out of the burner was set to 150 m/s, and the combustion assisting gas was heated to about 600° C.

TABLE 1

| Oxygen purity (%) | Melting efficiency (%) | | |
|---|---|---|---|
| | Heavy oil | LPG | Micropowdery coal |
| 40 | 15 | 13 | 0 |
| 60 | 45 | 40 | 35 |
| 80 | 55 | 47 | 45 |
| 100 | 60 | 50 | 47 |

As apparently shown in FIG. 1, the effect of the invention can notably be exhibited by using an oxygen gas having a purity of 60% or more as the combustion assisting gas, irrespective of the kind of fuel. Accordingly, it is desired to use a 60 to 100% purity oxygen gas as the combustion assisting gas.

In the burner 15, the fuel is burned at an oxygen-to-fuel ratio in the range of 0.55 to 0.99 to melt the metallic material 11 in the melting zone 14. While the oxygen-to-gas ratio of the combustion assisting gas is 1.0 under a normal burning condition, a satisfactory melting efficiency was obtained when a melting test was carried out according to this invention, in which iron scraps were melted by burning a micropowdery coal using a combustion assisting gas at the oxygen-to-gas ratio of 0.8. It was also found that iron scraps are hard to melt at an oxygen-to-gas ratio of 0.55 or less.

As described above, while oxidation of the metal to be melted or burning of the recarburizer can be reduced by burning the fuel at an oxygen-to-fuel ratio in the range of 0.55 to 0.99, to minimize the amount of $NO_x$ to be generated, an unburned gas is contained in the combustion gas 19 thus formed. The combustion gas 19 containing such unburned gas in the melting zone 14 flows up into the inlet zone 13 and passes through the gaps between the metallic material 11 stacked therein. In this process, $O_2$ is supplemented separately through oxygen lances 20 provided at a lower position of the inlet zone 13 to effect burning of the unburned portion in the combustion gas 19, and the resulting complete combustion gas 21 is led to the outside of the melting furnace 12 preheating the metallic material 11 in the inlet zone 13.

Incidentally, the preheating of the metallic material by the complete combustion gas may be carried out by using a preheater, provided independent of the melting furnace 12, and introducing the complete combustion gas into the preheater to which the metallic material is introduced.

According to a melting test carried out for iron scraps using a micropowdery coal, the melting efficiency, the metal loss and $NO_x$ generation, when the fuel was burned at the oxygen-to-fuel ratio of 1.0 as conventionally practiced, were 47%, ca. 5 to 7% and 4.0 g/kg-coal, respectively. On the other hand, when the micropowdery coal was burned by the burner at the oxygen-to-fuel ratio of 0.85 while $O_2$ is supplemented through the oxygen lances 20 into the inlet zone 13 in an amount equivalent to an oxygen-to-fuel ratio of 0.15, the melting efficiency, metal loss and $NO_x$ generation were 47%, ca. 1 to 2% and 1.0 g/kg-coal. Thus, not only can the metal loss due to oxidation and the like be greatly reduced, but also burning of the recarburizer can be prevented to minimize the amount of $NO_x$ by setting the oxygen-to-fuel ratio at the burner to 0.55 to 0.99 and by supplying separately the $O_2$ necessary to effect complete combustion of the unburned gas.

Further, it can also be pointed out that the $CO_2$ gas can easily be recovered, advantageously according to the embodiment of this invention, since the $CO_2$ gas concentration in the exhaust gas becomes relatively high, e.g. 50% or more.

To describe now the method of heating the combustion assisting gas referring, for example, to FIG. 1, the complete combustion gas 21 led out of the melting furnace 12 after preheating of the metallic material 11 in the inlet zone 13 is introduced through a pipe 22 to a heat exchanger 23 and exhausted through a pipe 24. In this process, the combustion assisting gas passing through the pipe 18 penetrating through the heat exchanger 23 is heated by heat exchange with the complete combustion gas 21.

Alternatively, as shown in FIG. 2, the combustion assisting gas is introduced to a heater 32 through a pipe 31 and after it is heated there to a high temperature, fed to a burner 15 through a pipe 18. The heater 32 is provided with a heating burner 34 for burning a gaseous or liquid fuel, such as LPG and LNG or heavy oil and kerosine, supplied through a pipe 33. The fuel fed to the heating burner 34 is burned in an oxygen-rich atmosphere in the heater 32 to heat the oxygen introduced to the heater 32 through the pipe 31.

By feeding the thus heated combustion assisting gas to the burner 15, as described above, combustion efficiency can be improved, and thus the method of the invention is particularly effective when a micropowdery coal is used as the fuel for melting a metal.

The metallic material 11 may be introduced to the melting furnace 12 either batchwise or continuously, and the melt need not be left in the well zone 16 of the melting furnace 12. Further, the metallic material starts to melt from the lower part of the stacked metal layer, and the metallic material slips down gradually as it melts.

What is claimed is:

1. A method of melting a metallic material, which comprises melting a metallic material introduced to a melting furnace by heating the metallic material directly with a flame from a fuel burner using an oxygen gas having an oxygen content of 60 to 100% as a combustion assisting gas; wherein said oxygen gas fed to said burner is burned at an oxygen-to-fuel ratio of 0.55 to 0.99 to produce a combustion gas, while an unburned portion of the combustion gas is burned by $O_2$ supplied separately.

2. The method of melting a metallic material according to claim 1, wherein said metallic material is preheated by combustion of said unburned portion of the combustion gas.

3. The method of melting a metallic material according to claim 1, wherein said combustion assisting gas is heated before being fed to said burner.

4. The method of melting a metallic material according to claim 3, wherein said combustion assisting gas is heated by the combustion gas exhausted from said melting furnace.

5. The method of melting a metallic material according to claim 3, wherein said combustion assisting gas is heated in a preheater provided separately.

* * * * *